US006066250A

United States Patent [19]

Kinjo

[11] Patent Number: 6,066,250

[45] Date of Patent: May 23, 2000

[54] METHOD FOR RECLAIMING INVESTMENT CASTING WAX COMPOSITIONS AND THE COMPOSITIONS OBTAINABLE THEREBY

[75] Inventor: Tsuneo Kinjo, Chiba, Japan

[73] Assignee: Kawasaki Steel Techno-Research Corporation, Tokyo, Japan

[21] Appl. No.: 09/186,684

[22] Filed: Nov. 5, 1998

[30] Foreign Application Priority Data

Nov. 7, 1997 [JP] Japan ..... 9-322214

[51] Int. Cl.[7] ..... C10G 73/00

[52] U.S. Cl. ..... 208/24; 106/388

[58] Field of Search ..... 106/388; 208/24

[56] References Cited

U.S. PATENT DOCUMENTS 5,006,583 4/1991 Argueso ..... 106/38.6

FOREIGN PATENT DOCUMENTS 48-032051 11/1969 Japan .
56-139253 10/1981 Japan .
7-039992 2/1995 Japan .

*Primary Examiner*—Helane Myers
*Attorney, Agent, or Firm*—Young & Thompson

[57] ABSTRACT

A used investment casting wax composition containing a filler and/or a residue after a wax component is removed from the composition is dissolved or dispersed into an organic solvent. The mixture is separated into a dissolved wax fraction and a wax-containing solids fraction. The organic solvent in the dissolved wax fraction is removed to recover a wax component, while the wax component and the organic solvent in the wax-containing solids fraction are removed to recover a crude filler. The crude filler is washed with water and/or an aqueous alkaline solution to recover a high-purity filler. A reclaimed investment casting wax thus obtainable is less degraded by heat.

19 Claims, 2 Drawing Sheets

METHOD FOR RECLAIMING INVESTMENT CASTING WAX COMPOSITIONS AND THE COMPOSITIONS OBTAINABLE THEREBY

BACKGROUND OF THE INVENTION

1. Field of the Invention

The present invention relates to a method for reclaiming an investment casting wax composition, and in particular to a method for recovering and reclaiming a wax component and a filler from a used investment casting wax composition containing the filler, which is liberated during a dewaxing process using an autoclave. The invention also relates to a reclaimed investment casting wax composition.

2. Description of the Related Art

Investment casting is a known technique for performing precision industrial casting. In this process, precise products are produced by forming a wax pattern having the same shape as the final product, by use of a silicone rubber matrix or a die, and covering the wax pattern with a refractory ceramic material. The wax covered with the refractory ceramic material pattern is then heated to remove the wax (dewaxing), and a mold made from the refractory is produced. Finally, a metal melt is cast into the mold to produce a precise product.

Dewaxing is generally performed by placing the ceramic-coated mold into an autoclave and heating with steam to a temperature of 150° C. to 180° C. to melt and remove the wax. The steam dewaxing process permits recovery and reclamation of wax. The reclaimed wax is reused to produce another pattern.

The recovered wax contains a variety of impurities, e.g. mold sand, iron scale generated during the autoclave treatment, and water introduced during the steam treatment. The recovered wax, therefore, must be purified before it can be reused for further molds. In recent years, an investment casting wax composition containing a polystyrene filler with an average particle size of 40 $\mu$m has been used in an amount of 20 to 30% by weight, to improve thermal conductivity of the wax and to prevent formation of sink marks at the heavy-gage section of the pattern. Since such a composition is expensive, reclamation of the used investment casting wax composition is now more important.

Industrial reclaiming processes for used investment casting wax compositions include sedimentation processes, centrifugal processes, and filtration processes. In sedimentation processes, a used investment casting wax composition is melted by heat so that impurities sink, and the supernatant (upper) layer is recovered. A sedimentation process requires that the used investment casting wax composition be maintained at a high temperature of higher than 100° C. for a day or more. This time-consuming process has some further disadvantages, such as degradation of the wax component and an inability to recover filler. On the other hand, the centrifugal process and the filtration process also cannot recover fillers, and have a further disadvantage of low recovery yield of wax, although they allow the processing time to be shortened.

Japanese Patent Laid-Open No. 56-139253 discloses a method for recovering wax used in an investment casting process, in which wax removed from an autoclave is rapidly cooled to be frozen, and then water in the wax is sublimated in a vacuum atmosphere to remove water from the wax. Japanese Patent Laid-Open No. 7-39992 discloses a method for purifying used wax, in which used wax removed from an autoclave and water are injected into a mixer, are mixed while feeding air to pulverize the used wax, and the pulverized wax is melted to separate the impurities.

These conventional processes do not contemplate recovery of the filler from a filler-containing wax that has been recently used. Thus, the conventional processes do not permit reuse of the filler and wax adhered to the filler. Supply of fresh filler is therefore necessary for reuse of the reclaimed wax composition according to the above processes. As described above, generally 20 to 30% of expensive organic filler is compounded in a wax composition, from which only the wax is recovered, and at a low yield. Thus, the conventional processes do not satisfy the demand of cost reduction by wax reclamation. Furthermore, the dumping of the residue including fillers causes an increased environmental impact.

SUMMARY OF THE INVENTION

Accordingly, it is an object of the present invention to provide a method for recovering and reclaiming a high purity wax component from a used investment casting wax composition or a residue thereof.

It is another object of the present invention to provide a method for recovering and reclaiming a filler from a used investment casting wax composition by treating a residue remaining after a wax component is extracted or separated.

It is still another object of the present invention to provide a method for recovering and reclaiming a wax component and a filler without deterioration of quality after impurities introduced by the wax mold have been removed.

It is a further object of the present invention to provide a method enabling cost reduction and material saving in a precise casting process using a used investment casting wax composition.

It is a still further object of the present invention to provide a reclaimed investment casting wax composition which is less degraded by heat.

A first aspect of the present invention is a method of reclaiming a used investment casting wax composition comprising: dispersing into an organic solvent at least one of a used investment casting wax composition and a residue obtained after separating or extracting a wax component from a used investment casting wax composition; separating the dispersion into a dissolved wax fraction and a wax-containing solids fraction; collecting the dissolved wax fraction; and removing the organic solvent from the dissolved wax fraction to recover the wax component.

A second aspect of the present invention is a method of reclaiming a used investment casting wax composition comprising: dispersing into an organic solvent at least one of a used investment casting wax composition containing a filler and a residue obtained after separating or extracting a wax component from the used investment casting wax composition; separating the dispersion into a dissolved wax fraction and a wax-containing solids fraction; separating the wax-containing solids fraction into a filler-containing portion and a solid impurity-containing portion; and removing the organic solvent from the filler-containing portion to recover the filler.

A third aspect of the present invention is a method for reclaiming a used investment casting wax composition comprising: dispersing into an organic solvent at least one of a used investment casting wax composition containing a filler and a residue obtained after separating or extracting a wax component from the used investment casting wax composition; separating the dispersion into a dissolved wax fraction and a wax-containing solids fraction; removing the wax component and the organic solvent from the wax-containing solids fraction to obtain a crude filler; adding water to the crude filler to dissolve water-soluble impurities and precipitate water-insoluble solid impurities; and removing the water to recover a purified filler.

A fourth aspect of the present invention is a method for reclaiming a used investment casting wax composition comprising: dispersing into an organic solvent at least one of a used investment casting wax composition containing a filler and a residue obtained after separating or extracting a wax component from the used investment casting wax composition; separating the dispersion into a dissolved wax fraction and a wax-containing solids fraction; removing the wax component and the organic solvent from the wax-containing solids fraction to obtain a crude filler; adding an aqueous alkaline solution to the crude filler to dissolve and remove impurities and to separate undissolved solid impurities; adding water to the residual filler-containing portion to remove by dissolving water-soluble impurities; and removing the water to recover a purified filler.

Another aspect of the present invention is a reclaimed investment casting wax composition obtainable by any one of the methods stated above.

In accordance with the present invention, the wax and filler components are effectively recovered from the solution or dispersion in an organic solvent of a used investment casting wax composition containing a filler. The recovered wax and filler are suitable for reuse in investment casting, since they are not significantly degraded because the processing temperature is not so high as in the above-discussed prior art. Since the reusable fraction is high, the method of the present invention contributes to environmental conservation. The method of recovering the wax component can also be applied to an investment casting wax composition containing no filler.

DESCRIPTION OF THE PREFERRED EMBODIMENTS

Figure 1:
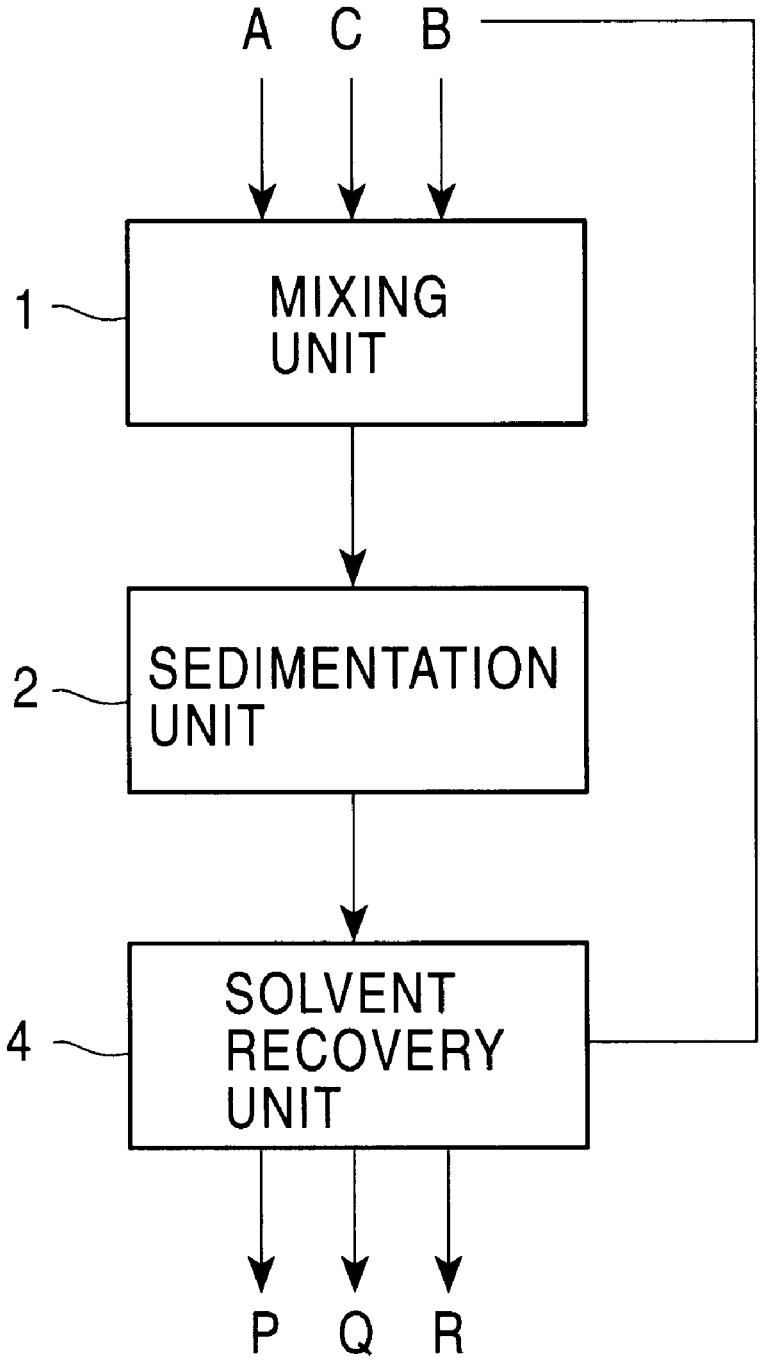
FIG. 1 is a system diagram of an apparatus for performing a method of the present invention.

The present inventor has discovered that when a used investment casting wax composition is dispersed in a solvent for the wax component, the resulting system quickly and spontaneously organizes itself into a dissolved wax fraction, a filler-rich fraction (which typically also includes undissolved wax adhered to the filler particles), and a mixed fraction containing wax and higher density solid impurities. Impurities originating from the lost wax mold may be dispersed in water or dissolved in an aqueous alkaline solution. For example, binders such as colloidal silica form a dispersion in water when they are not solid, and are soluble in an aqueous alkaline solution when they become solid. Thus, these impurities can be separated from the filler. The present invention has been completed based on the discovery and recognition of these phenomena.

For reclaiming an investment casting wax composition (which may or may not contain a filler), it is also possible first to separate or extract a portion of the wax component to leave a residue, whereafter the residue is dissolved or dispersed in an organic solvent to separate the residue into a dissolved wax fraction and a wax-containing solids fraction. The dissolved wax fraction is then collected, and the organic solvent is removed from the dissolved wax fraction to recover the wax component.

For recovery of filler during reclamation of an investment casting wax composition, the residue may be dissolved or dispersed in an organic solvent to separate the residue into a dissolved wax fraction and a wax-containing solids fraction, whereafter the wax-containing solids fraction is further separated into a filler-containing portion and a solid impurity-containing portion, and then the organic solvent is removed from the filler-containing portion to obtain a recovered filler.

In another variation of filler recovery, the wax component is separated or extracted from a used investment casting wax composition containing a filler, the residue is dissolved or dispersed in an organic solvent to separate the residue into a dissolved wax fraction and a wax-containing solids fraction, the organic solvent and wax component are removed from the wax-containing solids fraction to obtain a crude filler, water is added to the crude filler so that water-soluble impurities are dissolved, and then solid impurities are separated to recover a high-purity filler.

In this process, an aqueous alkaline solution is added to the crude filler to dissolve and remove impurities, and then the alkaline component in the filler-containing residue is removed with water, whereafter any remaining solid impurities are separated. A binder component that is insoluble in water is, thereby, removed and thus a filler with higher purity is recovered. In this process, it is preferable that the wax-containing solids fraction itself contains from the outset an aqueous phase formed during separation or extraction of the wax component from the used investment casting wax composition. Thereby no additional heat treatment step for disposing the aqueous phase is necessary.

In the above-mentioned processes, it is preferable that the organic solvent be hydrophobic, and have a boiling point of less than 100° C. In particular, n-hexane is most preferably used.

In these processes, it is preferable that an organic solvent be added to the wax-containing solids fraction to repeat the step of separating the dispersion into a dissolved wax fraction and a wax-containing solids fraction. The recovery yields of the wax component and the filler are thereby improved.

The present invention is applicable to a used investment casting wax composition containing a filler, after removal thereof from an autoclave. In this case, no additional melting treatment is required for separating the wax component from the used investment casting wax composition. The process therefore allows recovery of the wax and the filler without thermal deterioration. Further, the use of a water-insoluble solvent causes separation of the solvent fractions and the aqueous phase. The aqueous phase can be disposed by a nonthermal process or during washing with water as described later.

The present invention is also applicable to the residue of the used investment casting wax composition after initial extraction or separation of the wax component by a conventional sedimentation, centrifugal, or filtration process. In this case, since the investment casting wax composition has been melted by heat, the wax and filler components may deteriorate, but the process can be performed using less solvent. Thus, it is preferable that the period from melting to separation of the wax component be as short as possible. A centrifugal separation or filtration is, therefore, preferred. When the wax component is recovered by sedimentation, it may be recovered in a short time before impurities completely precipitate so that the residue contains a relatively large amount of wax component.

The used investment casting wax composition and/or the residue are mixed with a solvent to dissolve the wax component and to disperse the solids (including any filler). Any organic solvent that dissolves the wax component may be used in the present invention. Examples of the organic solvents include chloroform, benzene, toluene, xylene, n-hexane, cyclohexane, n-heptane, acetone, methanol, ethanol, kerosene, and mixtures thereof. The ratio of the solvent added to the investment casting wax composition or residue is not limited. The solvent is generally added to the investment casting wax composition or residue in a ratio of one to five times the total weight of the investment casting wax composition and the residue.

The boiling point of the solvent is preferably less than 100° C., since oxidative deterioration of the wax is significantly accelerated at a temperature of 100° C. or more. When a solvent having a low boiling point is used, the solvent can be removed from the wax without oxidation of the wax. The most preferable solvent is n-hexane, since it has high solubility for wax without causing deterioration of the polystyrene that is typically used as a filler. Further, it is not miscible with water; hence water contained in the used investment casting wax composition is more easily separated. Conventional steps for removing water from a used investment casting wax composition is not necessary when n-hexane is used, resulting in reduced thermal load. Since n-hexane has a low boiling point of 68.7° C., the dissolution/dispersion step can be performed at a relatively low temperature without deterioration of the wax and the filler. The boiling point of n-hexane is significantly lower than the wax; therefore, the solvent can be easily recovered with high purity for ease of reuse. Moreover, this solvent is commercially available and has minimal adverse effects on the human body.

An organic solvent is added to the used investment casting wax composition or residue, and then the mixture is heated with stirring if necessary. The wax component is largely dissolved, and the filler and impurities are dispersed into the organic solvent. The mixture (often referred to herein as "the dispersion") is separated into a dissolved wax fraction containing only the wax component and a wax-containing solids fraction containing solid components such as a filler.

Any process, for example, a sedimentation process may be used for such separation. In a sedimentation process, the mixture is allowed to stand as it separates into the upper layer (dissolved wax fraction) and the lower layer (wax-containing solids fraction) containing solid components such as a filler and, in some cases, water. That is, if water is present, it will be in the lower layer as an aqueous phase. Other separation methods include a centrifugal process and a filtration process.

In the present invention, the dissolved wax fraction is first collected to recover the wax component. Any conventional method in chemical engineering may be employed to recover the wax component in the present invention. For example, the dissolved wax fraction is heated to a temperature that is lower than the boiling point of the wax component and higher than the boiling point of the solvent, to evaporate the solvent. The recovered wax can be reused as a reclaimed wax after adjusting the ingredients. The solvent is recovered for reuse using any conventional condensation process.

Next, the filler is recovered from the lower layer as follows. The lower layer (wax-containing solids fraction) after sedimentation is separated into a filler-enriched portion containing relatively small amounts of impurities and a solid impurity-containing portion containing filler, iron scale, and sand. Together, the filler-containing portion and solid impurity-containing portion make up the wax-containing solids fraction. When the used investment casting wax composition contains water, an aqueous phase is also separated. After removing the aqueous phase and the solid impurity-containing portion, the solvent of the filler-containing portion is evaporated to recover the filler.

Although the recovered filler may contain residual amounts of the wax component, its recovery is still highly useful. The wax component can be removed using a solvent, if necessary. Since these portions or zones do not show a distinct boundary, it is preferable that the upper ⅔ to ⅘ fraction of the lower layer be treated as a filler-containing portion. The resulting filler, however, contains small amounts of impurities, e.g., a binder such as colloidal silica which is used for forming a lost wax mold, a modified substance from the binder and approximately 0.4% of ash. Thus, it is difficult for it to be reused as a virgin filler without further treatment.

In the present invention, the wax component is removed from the lower layer by dissolving into an organic solvent, and then the solvent is evaporated to obtain a crude filler. The crude filler is washed with water to remove water-soluble components in the binder. In this step, solid impurities remaining in the filler-containing portion are also removed, because the solid impurities are more readily separated from the filler in the aqueous phase than in the organic solvent fraction. After the water washing, the ash content is decreased to 0.25% or less.

In the water washing, water is added to the crude filler and the mixture is stirred while heating to sufficiently disperse the filler into water. Next, the dispersion is allowed to stand. The supernatant aqueous solution (which may be colored if it contains impurities) is removed from the sedimentary filler portion. The water washing treatment may be repeated. When the crude filler contains an undesirable amount of wax, a solvent is added to dissolve the wax component until the wax content of the crude filler reaches a desirable level. Heavy solid impurities such as mold sand and iron at the lower section of the sedimentary filler section are removed.

The water washing treatment is also applicable to the crude filler that is obtained from the residue after the wax component is recovered by a centrifugal or filtration process. In such a case, the dissolution step using the organic solvent of the wax component is repeated to sufficiently remove the wax component from the residue, before the water washing treatment is performed. The residue after the wax component is recovered may include an aqueous phase. A high-purity filler is thereby produced by treatment of the crude filler with water.

The resulting filler contains 0.25% or less of ash, as described above. If a filler having a lower ash content is desired, binder components that are modified by heat must be removed. The binder components include principally dehydrated colloidal silica. This can be removed by washing with an aqueous alkaline solution. That is, the crude filler is washed repeatedly with the aqueous alkaline solution. Although any type and concentration of the aqueous alkaline solution can be used, an aqueous 0.1% by weight sodium hydroxide solution is preferably used. In order to completely remove the alkaline component, the filler is thoroughly washed with water after the alkaline washing treatment. When the alkaline washing treatment is employed, the solid impurities can also be separated during the washing treatment. Thus, no subsequent step for separating the solid impurities is required.

FIG. 1 is a system diagram of an apparatus for performing a method of the present invention using sedimentation. The apparatus includes a mixing unit 1, a sedimentation unit 2, and a solvent recovery unit 4. The mixing unit 1 has a stirrer (not shown in the drawing), and receives a feed material A, which is a used investment casting wax composition and/or a residue after separating the wax component from the wax composition, a recycled solvent B, and supplemental fresh solvent C. The feed material and the solvent are mixed with the stirrer to dissolve most of the wax component and to disperse the filler and the solid impurities into the solvent.

The sedimentation unit 2 receives the dispersion from the mixing unit 1 and allows the dispersion to stand. The sedimentation unit 2 includes a reservoir having an inlet for receiving the dispersion and an outlet for collecting the dissolved wax fraction and the like, which are separated by sedimentation. Collection of the content may be performed by suction using a siphon or pump. The upper layer must be collected in a manner that it does not contain the components in the lower layer.

The mixing unit 1 may also function as a sedimentation unit 2, in which case the sedimentation unit 2 of FIG. 1 may be omitted. That is, after dissolution of the wax component is completed in the mixing unit 1, the stirring is stopped and the dispersion is left to stand in the mixing unit 1 for sedimentation.

The solvent recovery unit 4 separately receives individual fractions that are separated in the sedimentation unit 2. The solvent is evaporated to recover a wax component P, a wax/filler mixture or filler Q, and solid impurities R. The solvent recovery unit 4 has a heating unit for evaporating the solvent, a repelling unit for solid components such as wax, and a condenser for the evaporated solvent. The recovered solvent is reused as a recovered solvent B in the mixing unit 1. It is preferable to recover the solvent from the solid impurities in view of cost reduction and environmental preservation, although it is not always necessary.

Figure 2:
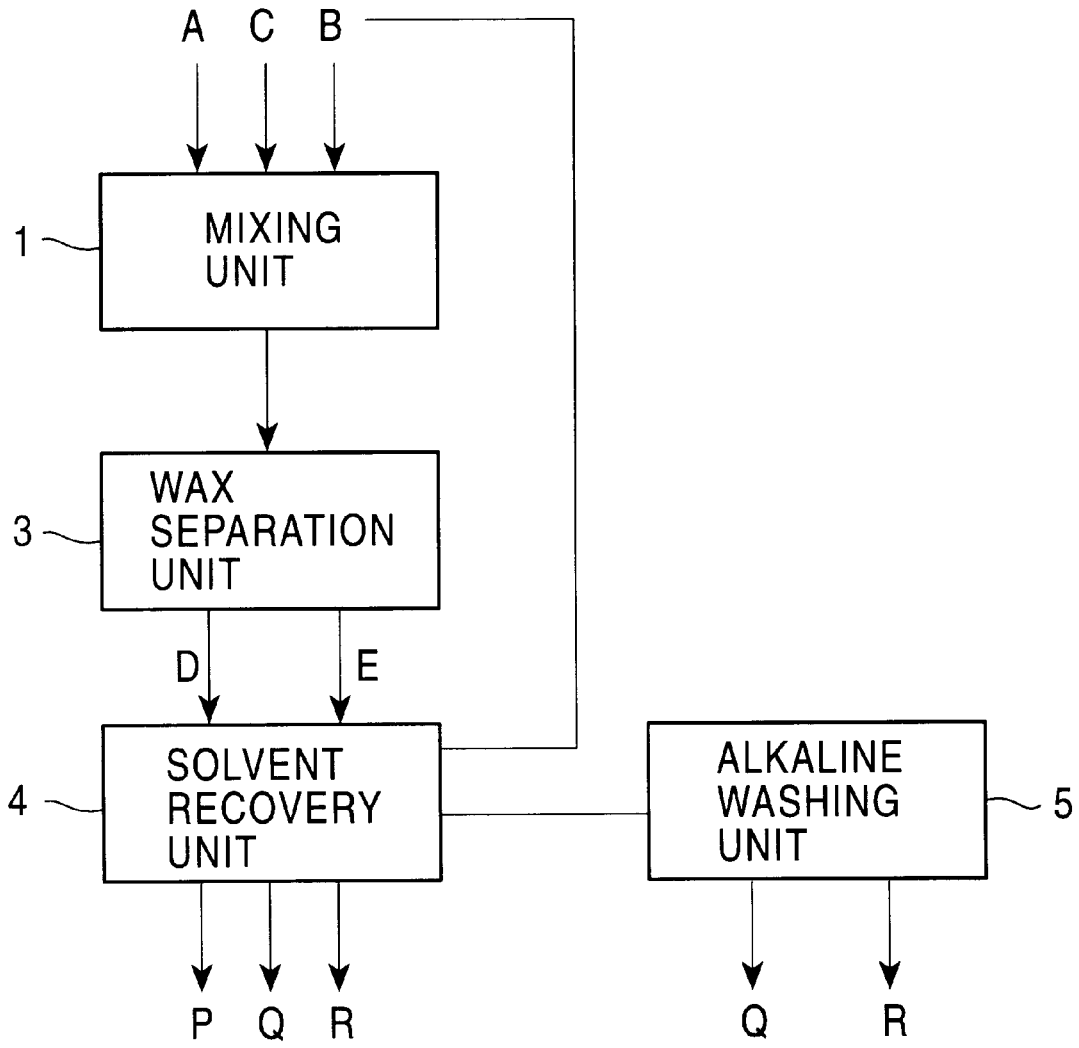
FIG. 2 is a system diagram of an apparatus including an alkaline washing unit for performing a method of the present invention.

FIG. 2 is a system diagram of an apparatus including a water washing and/or an alkaline washing unit for performing a method of the present invention. The apparatus includes a mixing unit 1, a wax separation unit 3, a solvent recovery unit 4, and an alkaline washing unit 5. The mixing unit 1 and the solvent recovery unit 4 have basically the same configurations as those in FIG. 1.

The wax separation unit 3 separates the mixture into a dissolved wax fraction D and a wax-containing solids fraction E, and generally has a centrifugal or filtration unit. By using a separation unit such as a centrifugal unit in place of the sedimentation unit 2 in FIG. 1, the dissolved wax fraction D is rapidly separated from the wax-containing solids fraction E and thus thermal deterioration of the wax and filler components is suppressed. The mixing unit 1 may function as a wax separation unit 3 in order to simplify the apparatus configuration. If necessary, a solvent may be added to the residue after the centrifugal separation to repeat the centrifugal separation.

The alkaline washing unit 5 has a reservoir, a mixing or stirring unit, and a repelling unit of the heavy deposition layer. In the reservoir, the crude filler or the residue after wax recovery containing the filler, the aqueous phase and the solid impurities are washed by the mixing or stirring unit with water and/or an aqueous alkaline solution, the mixture is left to stand, and heavy solid impurities are separated through the repelling unit.

A reclaimed investment casting wax composition obtainable by any of methods stated above is less degraded by heat than that by a conventional method.

EXAMPLE 1

A solvent, namely, 200 ml of n-hexane, was added to 200 g of a used investment casting wax composition. The mixture was heated to 50° C. and stirred to dissolve the wax component into the solvent, and then it was left to stand. The mixture was separated into an upper dissolved wax fraction, a middle wax-containing solids fraction (also containing solid impurities), and a lower colored aqueous phase. The dissolved wax fraction was collected. To the middle fraction and the lower fraction n-hexane was added again, and the mixture was heated to 50° C. and stirred to dissolve the wax component remaining in the wax-containing solids fraction. The mixture was left to stand.

The mixture was also separated into a dissolved wax fraction, a wax-containing solids fraction (also containing solid impurities), and an aqueous phase. The dissolved wax fraction was collected. These steps were repeated until the dissolved wax fraction became substantially clear. The collected dissolved wax fractions were unified and the solvent was removed by evaporation to recover the wax component.

The residue or ash after burning the recovered wax at 950° C. was 0.02%. The wax recovered in this process satisfies the standard of the ash content in the wax for investment casting, that is, 0.05%. Thus, the recovered wax is reusable in investment casting.

EXAMPLE 2

200 ml n-hexane was added to the wax-containing solids fraction (including an aqueous phase) obtained as in Example 1. The mixture was heated with stirring to the boiling point, and then was left to stand. The mixture was separated into a dissolved wax fraction, a wax-containing solids fraction, and an aqueous phase. A black and white sand component deposited in the lower layer of the wax-containing solids fraction, and a large-sand component deposited in the aqueous phase. The upper ⅔ portion of the wax-containing solids fraction was collected and the solvent was removed by evaporation to recover the filler.

The residue after burning the recovered filler at 950° C. was 0.45%. A combination of the recovered filler, the recovered wax prepared in EXAMPLE 1, and a virgin wax or a virgin filler allows preparation of a filler-containing wax composition having an ash content of 0.05% or less, because the recovered wax has an extremely low ash content of 0.02%.

EXAMPLE 3

400 ml pure water was added to the residue produced after removing the wax component from the recovered filler in EXAMPLE 2. The mixture was heated at 80° C. for 30 minutes to disperse the filler and to dissolve impurities in the water, and then was left to stand. A filler-containing fraction including heavy solid impurities was deposited. A colored supernatant solution was removed. These steps were repeated three times, before the supernatant solution became colorless. Next, 100 ml of pure water was added to the filler-containing fraction, and the mixture was stirred and left to stand. The heavy impurities deposited in the lower layer of the filler-containing fraction. The filler-containing fraction was fractionated into three sections, that is, 70%, 15%, and 15% by weight from the upper portion. Water in these fractions was removed by evaporation to recover fractionated fillers.

The fractionated fillers had ash contents of 0.25%, 0.31%, and 2.96%, after burning at 950° C. The results show that the ash content in the recovered filler can be reduced to a practical level by water washing. For example, when 10% of a recovered filler having an ash content of 0.25%, 10% of a virgin filler containing no ash, and 80% of a recovered wax are mixed, the wax composition has an ash content of 0.041% and satisfies the above-mentioned standard of 0.05% or less. Thus, 70 to 80% of filler that is contained in the used investment casting wax composition is recovered as a reclaimed filler which can be mixed with a reclaimed wax.

EXAMPLE 4

200 g of a used investment casting wax composition was combined with 200 ml of n-hexane. The mixture was heated with stirring to dissolve or disperse the components, and was left to stand. The mixture was separated into a dissolved wax fraction and a wax-containing solids fraction (also containing solid impurities). The dissolved wax fraction was collected, and the solvent was removed by evaporation to recover a wax component.

Again, n-hexane was added to the wax-containing solids fraction. The mixture was heated with stirring to disperse the wax-containing solids fraction, and left to stand. The mixture was separated into a dissolved wax fraction and a filler-containing fraction (also containing solid impurities). The dissolved wax fraction was collected, and the solvent was removed by evaporation to recover a wax component. These steps were repeated five times, until the dissolved wax fraction became substantially clear (this indicates that the solution is substantially free of the wax component).

The solvent was removed by evaporation from the resulting filler-containing fraction to recover a crude filler. The crude filler was placed into an aqueous alkaline solution of 200 ml of water and 0.2 g of sodium hydroxide. The mixture was heated at approximately 80° C. for 1 hour to dissolve alkaline-soluble components in the crude filler, and then left to stand. The mixture was separated into a blackish brown supernatant fraction, and a filler deposit fraction containing solid impurities. The supernatant fraction was removed. To the residual filler deposit fraction, 400 ml of pure water was added. The mixture was heated at approximately 80° C. for 30 minutes, and then left to stand. The supernatant solution was removed. In order to completely remove the alkaline component, these steps were repeated four times. Next, 100 ml of pure water was added, and the mixture was stirred and left to stand. Heavy solid impurities deposited in the lower layer of the filler deposit fraction. The filler deposit fraction was fractionated into three sections, that is, 70%, 15%, and 15% by weight from the upper portion. Water in these fractions was removed by evaporation to recover fractionated fillers.

The fractionated fillers had ash contents of 0.08%, 2.83%, and 3.27%, after burning at 950° C. The results show that approximately 70% of the recovered filler is a high-purity filler containing ash of less than 0.1%. Thus, the alkaline washing treatment effectively removes not only the alkaline-soluble impurities, but also alkaline-insoluble solid impurities as precipitate. When 20% of the recovered filler and 80% of a recovered wax are mixed, the reclaimed wax composition has an ash content of 0.032%. Accordingly, a reclaimed wax having significantly high purity can be produced by an alkaline washing treatment.

While the present invention has been illustrated above by the disclosure of various preferred embodiments, it is to be understood that those embodiments should not be viewed as limiting the scope of the invention in any way. Those skilled in this art, after studying this specification, will recognize numerous modifications and substitutions of equivalent techniques, which do not represent a departure from the basic teachings set forth herein. All such modifications and substitutions are to be regarded as falling within the true scope and spirit of the appended claims.

What is claimed is:

1. A method of reclaiming an investment casting wax composition, comprising:

dispersing into an organic solvent at least one of a used investment casting wax composition and a residue obtained after removing a wax component from a used investment casting wax composition;

separating the dispersion into a dissolved wax fraction and a solids-containing fraction;

collecting the dissolved wax fraction; and removing the organic solvent from the dissolved wax fraction to recover the wax component.

2. The method according to claim 1, wherein the organic solvent is hydrophobic, and the boiling point of the organic solvent is less than 100° C.

3. The method according to claim 2, wherein the organic solvent is n-hexane.

4. A method of reclaiming an investment casting wax composition, comprising:

dispersing into an organic solvent at least one of a used investment casting wax composition containing a filler and a residue obtained after separating or extracting a wax component from the used investment casting wax composition;

separating the dispersion into a dissolved wax fraction and a wax-containing solids fraction;

separating the wax-containing solids fraction into a filler-containing portion and a solid impurity-containing portion; and removing the organic solvent from the filler-containing portion to recover the filler.

5. The method according to claim 4, wherein the organic solvent is hydrophobic, and the boiling point of the organic solvent is less than 100° C.

6. The method according to claim 5, wherein the organic solvent is n-hexane.

7. The method according to claim 4, further comprising adding an organic solvent to the wax-containing solids fraction to obtain a solution, and separating the solution into a dissolved wax portion and a wax-containing solids portion.

8. A method of reclaiming an investment casting wax composition, comprising:

dispersing into an organic solvent at least one of a used investment casting wax composition containing a filler and a residue obtained after separating or extracting a wax component from the used investment casting wax composition;

separating the dispersion into a dissolved wax fraction and a wax-containing solids fraction;

removing the wax component and the organic solvent from the wax-containing solids fraction to obtain a crude filler;

adding water to the crude filler to dissolve impurities and separate solid impurities; and removing the water to recover a purified filler.

9. The method according to claim 8, wherein the wax-containing solids fraction includes an aqueous phase.

10. The method according to claim 8, wherein prior to the step of adding water, an aqueous alkaline solution is added to the crude filler for dissolving impurities.

11. The method according to claim 10, wherein the wax-containing solids fraction includes an aqueous phase.

12. The method according to claim 8, wherein the organic solvent is hydrophobic, and the boiling point of the organic solvent is less than 100° C.

13. The method according to claim 12, wherein the organic solvent is n-hexane.

14. The method according to claim 8, further comprising adding an organic solvent the wax-containing solids fraction to obtain a solution, and separating the solution into a dissolved wax portion and a wax-containing solids portion.

15. A method for reclaiming an investment casting wax composition, comprising:

dispersing into an organic solvent at least one of a used investment casting wax composition containing a filler and a residue obtained after separating or extracting a wax component from the used investment casting wax composition;

separating the dispersion into a dissolved wax fraction and a wax-containing solids fraction;

removing the wax component and the organic solvent from the wax-containing solids fraction to obtain a crude filler;

adding an aqueous alkaline solution to the crude filler to dissolve impurities and to separate undissolved solid impurities;

adding water to the residual crude filler to remove by dissolving water-soluble impurities; and removing the water to recover a purified filler.

16. The method according to claim 15, wherein the wax-containing solids fraction includes an aqueous phase.

17. The method according to claim 15, wherein the organic solvent is hydrophobic, and the boiling point of the organic solvent is less than 100° C.

18. The method according to claim 17, wherein the organic solvent is n-hexane.

19. The method according to claim 15, further comprising adding an organic solvent to the wax-containing solids fraction to obtain a solution, and separating the solution into a dissolved wax portion and a wax-containing solids portion.

* * * * *